US005137249A

United States Patent [19]

Royster

[11] Patent Number: 5,137,249

[45] Date of Patent: Aug. 11, 1992

[54] OUTBOARD MOTOR MOUNT FOR CANOE

[76] Inventor: James N. Royster, 17 Shipyard Rd., Middle Haddam, Conn. 06456

[21] Appl. No.: 739,681

[22] Filed: Aug. 2, 1991

[51] Int. Cl.[5] ..... F16M 13/00

[52] U.S. Cl. ..... 248/642; 248/231.6

[58] Field of Search ..... 248/640-643, 248/231.6

[56] References Cited

U.S. PATENT DOCUMENTS

| | | | |
|---|---|---|---|
| 2,042,598 | 6/1936 | Harvey . | |
| 2,475,889 | 7/1949 | Hafele . | |
| 3,601,344 | 8/1971 | Nourse . | |
| 3,645,483 | 2/1972 | Bartosch et al. . | |
| 3,918,666 | 11/1975 | Florian . | |
| 3,941,072 | 3/1976 | Caton et al. . | |
| 3,944,178 | 3/1976 | Greenwood | 248/231.6 |
| 4,382,574 | 5/1983 | Ellestad . | |
| 4,676,756 | 6/1987 | Rodrigue et al. . | |
| 4,690,649 | 9/1987 | Zeimet . | |
| 4,819,905 | 4/1989 | McCain . | |
| 4,943,251 | 7/1990 | LeRach et al. . | |

*Primary Examiner*—Alvin C. Chin-Shue

[57] ABSTRACT

A motor mounting assembly for canoes and the like includes a clamping assembly extends athwartships at a point forwardly of the stern with a support member with end portions adapted to extend over and outwardly of the sides of the canoe, a clamping member adapted to engage under the gunwales of the canoe, and adjustable fasteners and to releasably draw the members together to clamp them to the canoe. At its aft end a transom mounting member extends generally in a vertical direction along the stem of the canoe and is adapted to support an outboard motor on its upper end. A pair of adjustable arms are secured to the support member of the clamping assembly and to the transom mounting member. A stabilizer is engaged with the transom mounting member and to the stem of the canoe. Adjustable arm stabilizers interconnect the arms intermediate their length and rigidify the assembly.

20 Claims, 4 Drawing Sheets

OUTBOARD MOTOR MOUNT FOR CANOE

BACKGROUND OF THE INVENTION

The present invention relates to outboard motor mounts and, more particularly, to an apparatus for mounting outboard motors on the stern of a canoe.

Because of the desirability of being able to propel a canoe or like double ended vessels by means of an outboard motor, a number of different types of devices have been proposed which would enable the mounting of an outboard motor on such a vessel. Among such devices are those illustrated in Hafele U.S. Pat. No. 2,475,889, Nourse U.S. Pat. No. 3,601,344, Bartosch U.S. Pat. No. 3,645,483, Florian U.S. Pat. No. 3,918,666, Canton et al U.S. Pat. No. 3,941,072, Ellestad U.S. Pat. No. 4,382,574, Ziemet U.S. Pat. No. 4,690,649, and McCain U.S. Pat. No. 4,819,905. Some of the devices illustrated in these patents require customization for the particular dimensions and configuration of the canoe involved or require semi-permanent mounting to the canoe. Others are relatively complicated in construction, and/or in the manner of assembly and disassembly from the canoe. Others lack a desirable degree of rigidity and security in the mounting to the canoe. Others lack the desirable feature of locating the outboard motor behind the centerline of the vessel.

It is an object of the present invention to provide a novel motor mounting assembly for use with canoes and the like which is adjustable for varying vessel dimensions while providing a relatively firm and secure attachment to the canoe.

It is also an object to provide such a motor mounting assembly which may be fabricated readily and relatively economically, and which may be easily assembled and disassembled from the canoe.

Another object is to provide such a motor mounting assembly which requires minimal modification or permanent alteration of the canoe and which substantially avoids defacing the cosmetic appearance of the canoe.

SUMMARY OF THE INVENTION

It has now been found that the foregoing and related objects and advantages may be readily attained in a motor mounting assembly for canoes and the like comprising which includes a clamping assembly adapted to extend athwartships of the canoe at a point forwardly of its stern. This clamping assembly has a support member with end portions adapted to extend over and outwardly of the sides of the canoe perpendicular to the vessel's center line and which is supported on its gunwales, a clamping member adapted to engage under the gunwales of the canoe, and adjustable fasteners engaging the support and clamping members for releasably drawing them together to clamp them to the canoe. At the aft end of the assembly is a transom mounting member which extends generally in a vertical direction directly behind the stern of the canoe. A pair of adjustable arms are secured to each end of the support member of the clamping assembly, and at the other end to the upper sides of the transom member. The transom member is vertically stabilized by a support member that extends downwardly from the transom member and which is secured to the stern stem of the canoe at a point spaced downwardly from its gunwales.

In the preferred embodiment, there is included a means for stabilizing the arms intermediate the length of the arms which interconnects the arms and rigidifies the assembly In the preferred embodiment, the stabilizing support member that extends downwardly from the transom member and is secured to the stern stem of the canoe is adjustable upwardly and downwardly. This adjustment will account for different vessel designs and ensure that the transom is located at a constant elevation from the water commensurate with the established lengths of outboard motor drive assemblies.

Desirably, the adjustable arms comprise telescoping tubular elements, and means for releasably locking the tubular elements in a desired length. The adjustable arms are mounted to the transom mounting member by a rod extending therethrough and through the transom mounting member.

Preferably, the transom mounting member includes an elongated element and the upper end of the support member is engaged therewith. The support member bar and clamping member have resiliently compressible surface elements thereon. The arm stabilizing means comprises a pair of diagonally extending and intersecting members providing an X-shaped configuration.

DETAILED DESCRIPTION OF THE PREFERRED EMBODIMENT

Figure 1:
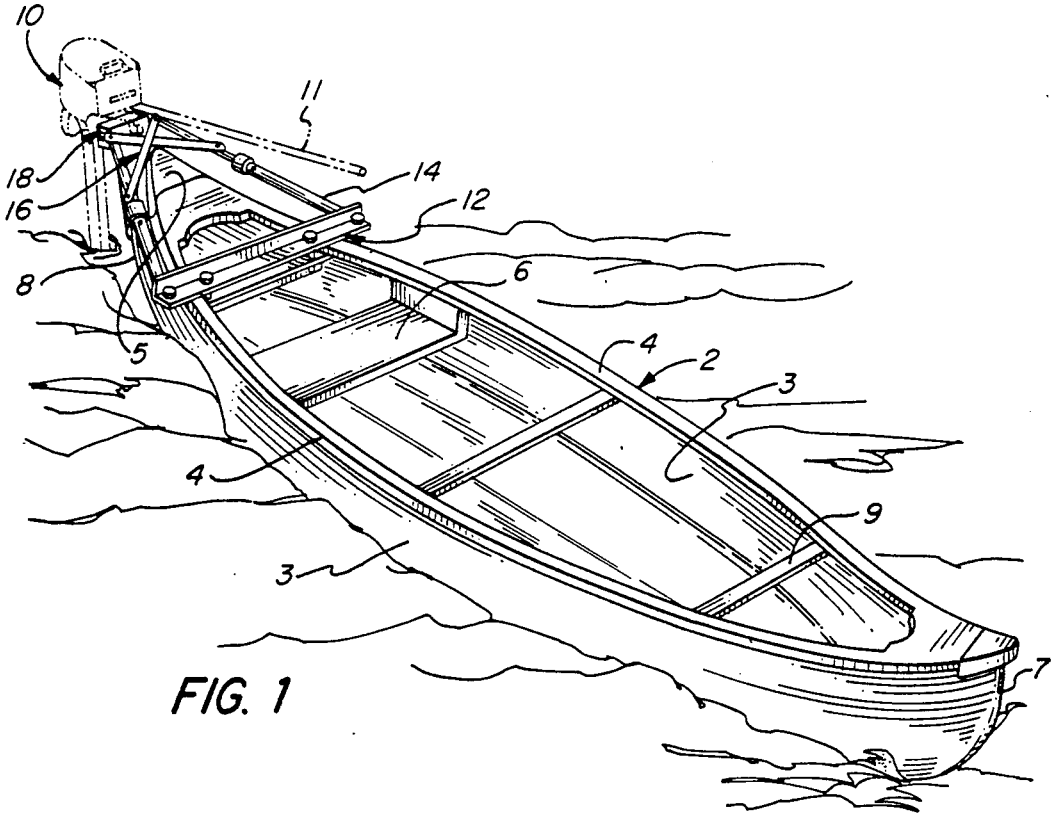
FIG. 1 is a perspective view of a canoe upon which has been mounted a motor mounting assembly embodying the present invention and showing in phantom line an outboard motor supported thereon.

Turning first to FIG. 1, therein illustrated is a canoe generally designated by the numeral 2 having a bow 7, stern 8, and sides 3 with gunwales 4 along the upper ends thereof. Also shown are the stern deck 5, seat 6, and athwartships braces 9.

Mounted on the after end of the canoe 2 is the motor mounting assembly embodying the present invention which includes the clamping assembly generally designated by the numeral 12 which is secured to the gunwales 4, the adjustable arm assembly generally designated by the numeral 14, the motor mounting member generally designated by the numeral 18 extending downwardly along the aft end of the canoe 2, and the reinforcing assembly generally designated by the numeral 16.

Mounted on the motor mounting member 18 is an outboard motor 10 illustrated in phantom line only and having a steering rod extension 11 also shown in phantom line.

Figure 6:
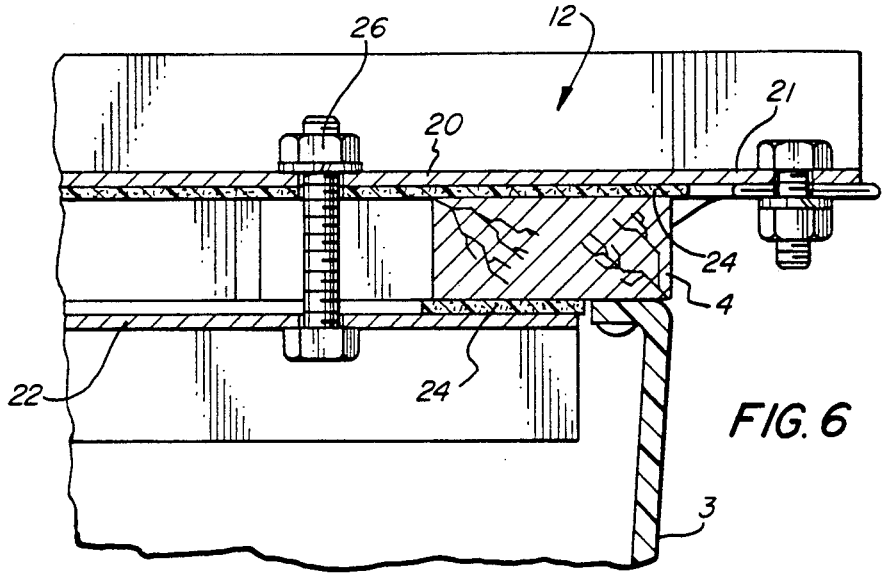
FIG. 6 is a fragmentary sectional view along the line 6—6 of FIG. 5.
Figure 2:
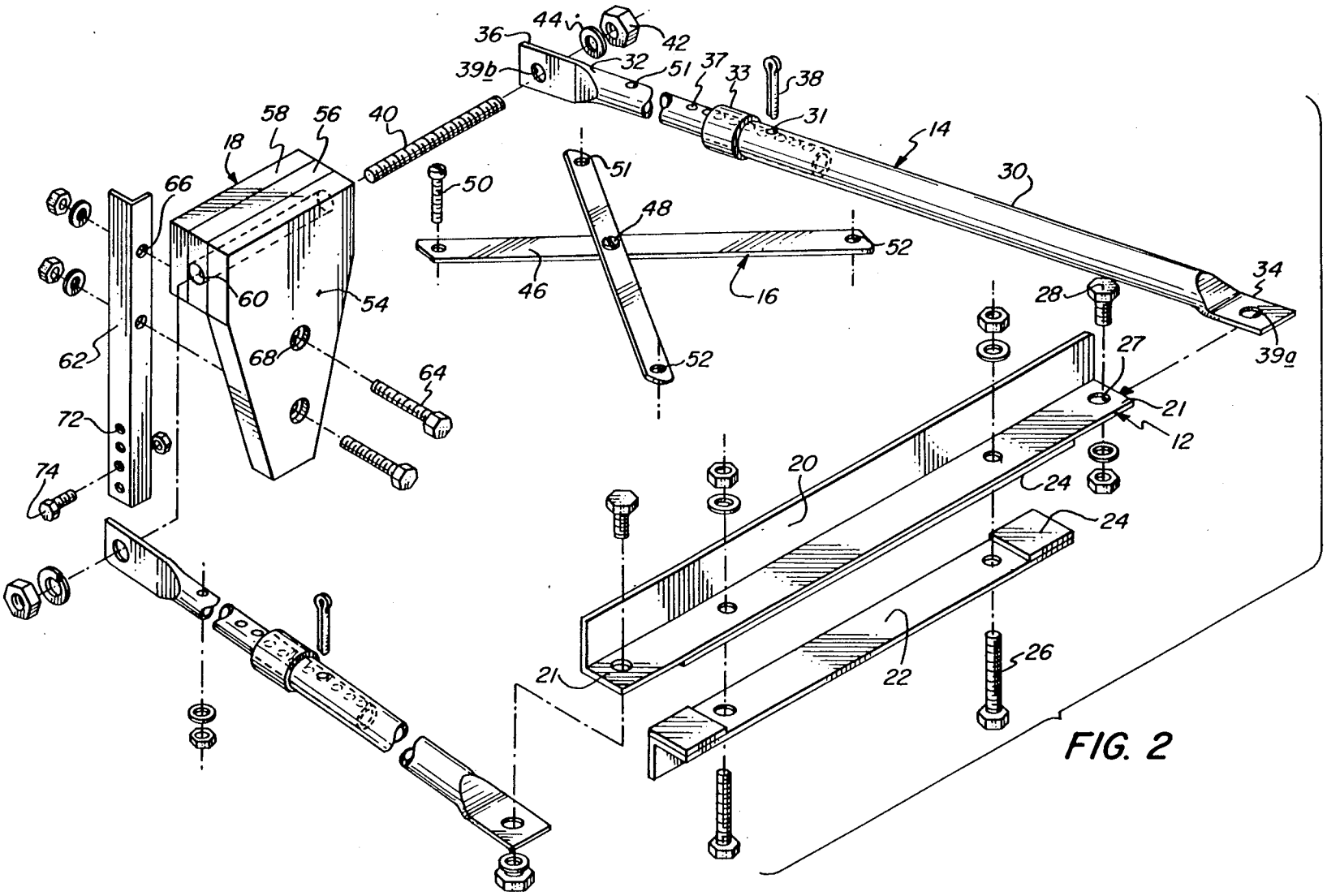
FIG. 2 is a partially exploded view of the elements of the motor mounting assembly of FIG. 1 with the exception of the bracket mounted to the stern stem.

Turning now to FIG. 2, substantially all of the elements of the motor mounting assembly of the present invention are shown in partially exploded view. The clamping assembly 12 includes the top clamping element 20 which has end portions 21 seated on and extending outwardly of the gunwales 4 of the canoe 2 as seen in FIG. 6, and the bottom clamping element 22 which is disposed under the gunwales 4 as also seen in FIG. 6. Clamping the elements 20, 22 together are the threaded fasteners 26, and protective elements 24 of resiliently compressible synthetic resin material are provided to minimize scratching or other injury to the surface of the gunwales 4 which are clamped therebetween.

Figures 3, 4:
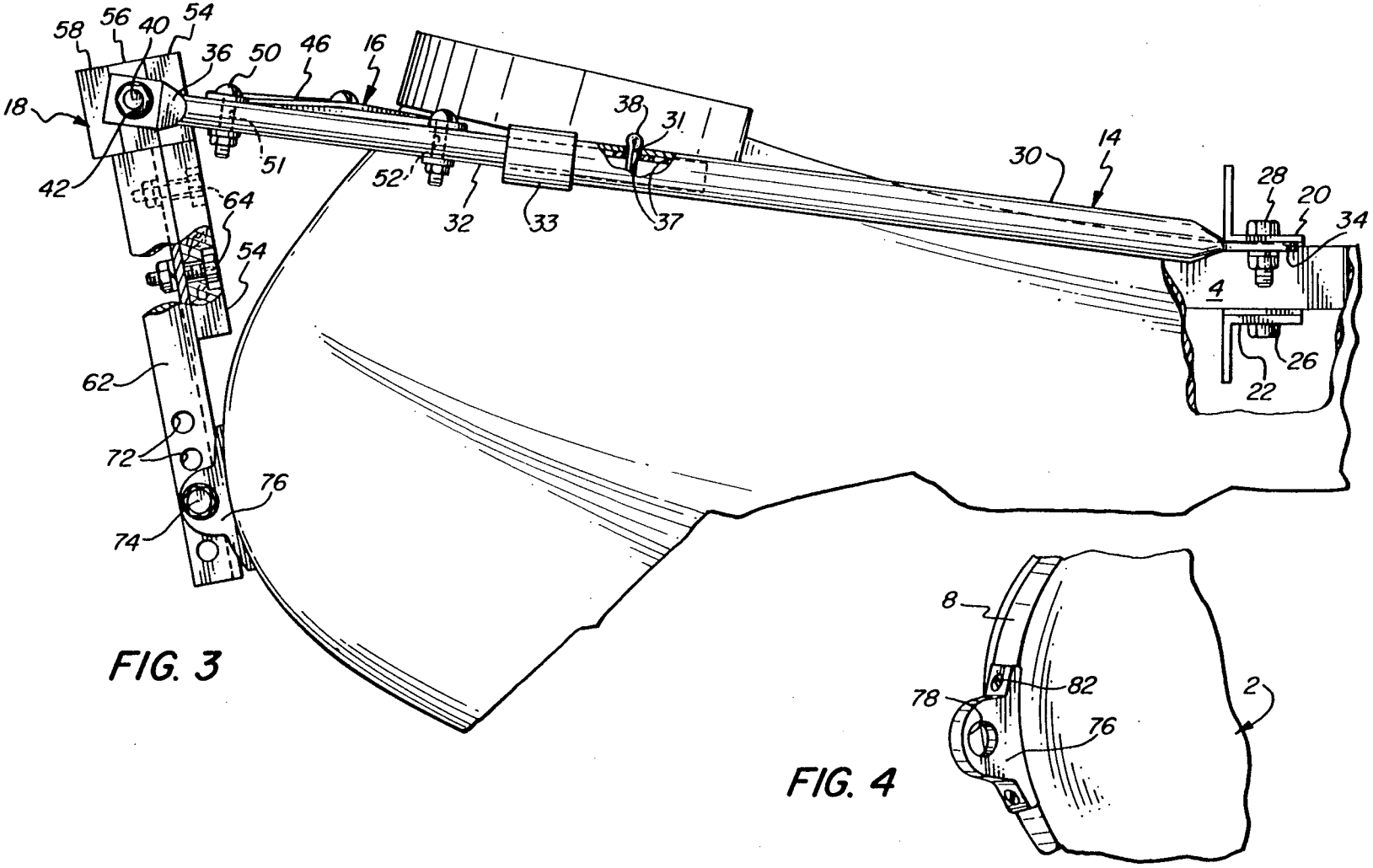
FIG. 3 is a fragmentary side elevational view of the stern of the canoe in FIG. 1 showing the motor mounting assembly thereon with portions in partial section to reveal internal construction.
FIG. 4 is a fragmentary perspective view of the stern of the canoe showing the bracket affixed to its stern stem.
Figure 5:
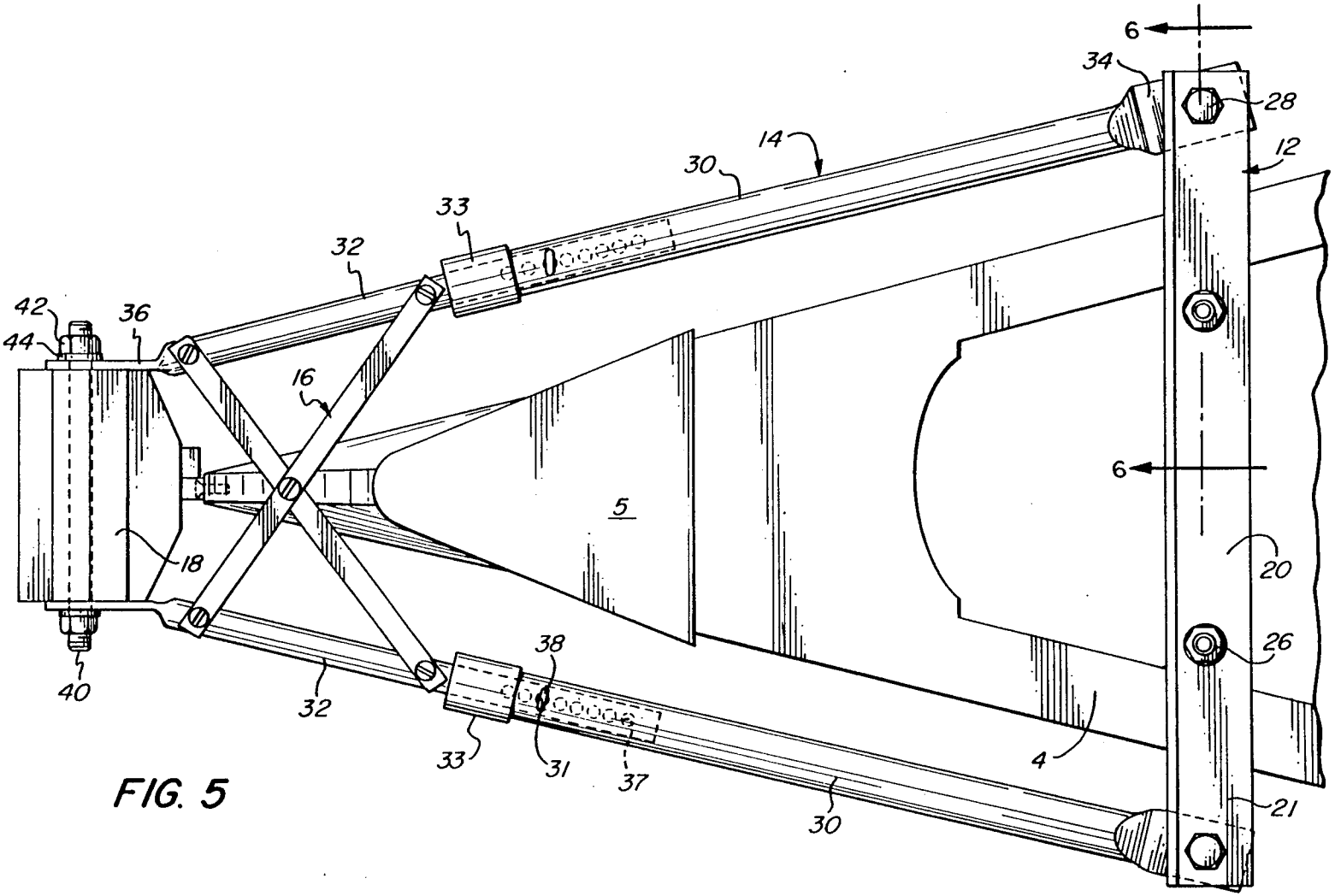
FIG. 5 is a fragmentary top plan view of the rear portion of the canoe of FIG. 1.

The arm assembly 14 is comprised of two adjustable arms provided by the tubular telescoping members 30, 32. The front member 30 has a reinforcing sleeve 33 at its after end, and it has an aperture 31 extending through the wall thereof at a point spaced forwardly of its after end. The after telescoping member 32 has a series of apertures 37 therein which may be aligned with the aperture 31 to receive a cotter pin 38 or the like to provide a fixed adjustable length for the assembled telescoping members 30, 32. The free ends of the telescoping members 30, 32 are flattened as indicated by the numerals 34, 36 and are provided with apertures 39*a* and 39*b* for attachment to other components of the assembly. As seen in FIGS. 3, 5 and 6, the flattened ends 34 of the forward telescoping members 30 are engaged with the end portions 21 of the top clamping elements 20 by fasteners 28 which extend through the apertures 39*a* and the apertures 27 in the end portions 21.

Seated in apertures 39*b* the flattened end portions 36 of the aft telescoping members 32 is the elongated threaded rod 40 which extends through and supports the motor mounting member 18. Nuts 42 and washers 44 lock the threaded rod 40 securely in the ends of the telescoping members 32, which are held tightly against the side surfaces of the motor mounting member 18.

As can be seen, the motor mounting member 18 is comprised of an elongated element 54, center element 56 and rear element 58 which together provide a suitable thickness at the upper end of the motor mounting member 18 to permit secure clamping of the motor 10 thereon. In addition, lamination of the motor mounting member 18 from the three elements 54, 56 and 58 provides a relatively high strength member in the area where the maximum stresses occurs, i.e., where the motor 10 is mounted and where the motor mounting member 18 supported on the rod 40. As can be seen, the center element 56 is provided with a transverse passage 60 through which the threaded rod 40 extends.

Attached to the aft surface of the elongated element 54 is a vertical brace 62 which is secured in position by the fasteners 64 extending through the apertures 68 in the element 54 and apertures 66 in the brace 62. The brace 62 extends below the elongated element 54 and is provided with a series of vertically spaced apertures 72 adjacent its lower end. As seen in FIGS. 3 and 4, a bracket 76 with a transversely extending aperture 78 therein is secured to the stem of the canoe 2 by the fasteners 82. The lower end of the vertical brace 62 is secured to the bracket 76 by the fastener 74 which extends through the appropriate aperture 72 and the aperture 78 to firmly stabilize the motor mounting member 18 and the rear end of the assembly.

To stabilize and reinforce the assembly at the load end adjacent the motor 10, the reinforcing and stabilizing assembly 16 is provided. A pair of stabilizer elements 46 extend diagonally between the after end of the telescoping members 32 and diagonally across to the opposite telescoping member 32 at a point spaced forwardly thereof. Fasteners 50 extend through apertures 51 at the aft ends of the stabilizer element 46 and telescoping members 32 and through the apertures 52 in the forward ends of the stabilizer elements 46 and through apertures 52 in the telescoping members 32 at more forwardly points. The stabilizer elements 46 intersect to provide an X-shaped configuration and are secured in assembly by the pivot bolt 48.

In assembling the device, the clamping assembly 12 will be located in the appropriate position along the after end of the canoe so that the clamping elements 20 and 22 will securely clamp the gunwales 4 therebetween. The bracket 76 is secured to the stern stem 8 at an appropriate vertical position along its vertical length by the fasteners 82.

The arm assembly 14 is secured to the clamping assembly 12 by the fasteners 28, and the vertical brace 62 is secured to the motor mounting member 18 which is then mounted to the ends of the telescoping members 32 by passing the threaded rod 40 therethrough and into the apertures at the rear end of the telescoping members 32.

The stabilizing assembly 16 is then assembled to the telescoping members 32, and the motor mounting member is adjusted to the desired height and a fastener 74 is then passed through the appropriate adjustment aperture 72 in the vertical brace 62 and through the aperture 78 in the bracket 76 to tie the entire assembly together. At this point, the motor mounting assembly is ready to receive the motor 10 which is clamped to the upper end of the motor mounting member 18.

It will be appreciated that variations in the design and configuration of the various elements may be effected within the spirit of the present invention. Although telescoping tubular elements are used for the arm assembly, other relatively adjustable elements may also be employed. It will be appreciated the use of tubular elements provides high strength at relatively low cost. The use of angle members for various elements is also desirable because of the strength which is provided at low cost and because or their availability. However, bar stock may also be employed if so desired.

Thus, it can be seen from the foregoing detailed specification and the attached drawings that the motor mounting assembly of the present invention is readily used with canoes and other vessels having canoe shaped sterns. It provides a relatively firm and secure assembly, and it may be readily adapted to canoes of different size. The components may be fabricated readily and relatively economically, and they may be easily assembled and disassembled from the canoe. Moreover, minimal modification or permanent alteration of the canoe is required since only the bracket need be permanently secured to the stem.

Having thus described the invention, what is claimed is:

1. A motor mounting assembly of generally triangular configuration for canoes and the like comprising:

(a) a clamping assembly adapted to extend athwartships of an associated canoe at a point forwardly of its stern and including a support member extending athwartships of the associated canoe with end portions adapted to extend over and outwardly of the sides of the canoe and to be supported on its gunwales, a clamping member adapted to engage under the gunwales of the canoe, and adjustable fasteners engaging said support and clamping members for releasably drawing them together to clamp them to the associated canoe;

(b) a transom mounting member adapted to extend generally in a vertical direction along the stem of the canoe and to support an outboard motor on its upper end;

(c) a pair of adjustable length arms secured adjacent one end thereof to said end portions of said support member of said clamping assembly and at the other end to said transom mounting member, said arms converging towards said other ends and transom member and being adapted to extend adjacent the gunwales of the associated canoe; and (d) stabilizing means engaged with said transom mounting member and including a member depending from said transom mounting member and means adjacent the lower end of said depending member for fixedly engaging said depending member to the stem of the canoe at a point spaced downwardly from its gunwales, said transom mounting member being pivotably connected to said adjustable length arms and to said fixed engaging means of said stabilizing means to permit adjustment of its vertical orientation.

2. The motor mounting assembly in accordance with claim 1 wherein there is included adjustable arm stabilizing means interconnecting said adjustable length arms intermediate their length and rigidifying the assembly.

3. The motor mounting assembly in accordance with claim 1 wherein said fixedly engaging means of said transom member stabilizing means includes a bracket adapted to be secured to the stern stem of the canoe, and adjustable fastening means for varying the length of said elongated member between said transom mounting member and said bracket.

4. The motor mounting assembly in accordance with claim 1 wherein said adjustable length arms comprise telescoping tubular elements, and means for releasably locking said tubular elements in a desired length.

5. The motor mounting assembly in accordance with claim 1 wherein said adjustable length arms are mounted at said other end to said transom mounting member by a rod extending therethrough and through said transom mounting member.

6. The motor mounting assembly in accordance with claim 1 wherein said transom mounting member includes an elongated element and the upper end of said depending member of said stabilizing means is engaged therewith.

7. The motor mounting assembly in accordance with claim 1 wherein said support member bar and clamping member have resiliently compressible surface elements thereon.

8. The motor mounting assembly in accordance with claim 2 wherein said arm stabilizing means comprises a pair of diagonally extending and intersecting members providing an X-shaped configuration.

9. A motor mounting assembly of generally triangular configuration for canoes and the like comprising:

(a) a clamping assembly adapted to extend athwartships of an associated canoe at a point forwardly of its stern and including a support member extending athwartships of the associated canoe with end portions adapted to extend over and outwardly of the sides of the canoe and to be supported on its gunwales, a clamping member adapted to engage under the gunwales of the canoe, and adjustable fasteners engaging said support and clamping members for releasably drawing them together to clamp them to the associated canoe;

(b) a transom mounting member adapted to extend generally in a vertical direction along the stem of the canoe and to support an outboard motor on its upper end;

(c) a pair of adjustable length arms secured adjacent one end thereof to said end portions of said support member of said clamping assembly and at the other end to said transom mounting member, said arms converging towards said other ends and transom member and being adapted to extend adjacent the gunwales of the associated canoe, said adjustable arms comprising telescoping tubular elements, and means for releasably locking said tubular elements in a desired length;

(d) stabilizing means engaged with said transom mounting member and adapted to be secured to the stern of the canoe at a point spaced downwardly from its gunwales and said transom member stabilizing means including an elongated member secured to said transom mounting member and depending therefrom, a bracket adapted to be fixedly secured to the stern stem of the canoe, and adjustable fastening means for varying the length of said elongated member between said transom mounting member and said bracket, said transom member being pivotably connected to said adjustable length arms and to said bracket of said stabilizing means to permit adjustment of its vertical orientation; and (e) adjustable arm stabilizing means interconnecting said adjustable length arms intermediate their length and rigidifying the assembly.

10. The motor mounting assembly in accordance with claim 9 wherein said adjustable length arms are mounted at said other end to said transom mounting member by a rod extending therethrough and through said transom mounting member.

11. The motor mounting assembly in accordance with claim 9 wherein said transom mounting member includes an elongated element and the upper end of said depending member of said stabilizing means is engaged therewith.

12. The motor mounting assembly in accordance with claim 1 wherein said support member bar and clamping member have resiliently compressible surface elements thereon.

13. The motor mounting assembly in accordance with claim 9 wherein said arm stabilizing means comprises a pair of diagonally extending and intersecting members providing an X-shaped configuration.

14. In combination with an outboard motor and a canoe having sides with gunwales, a bow, and a stern with a stem, a motor mounting assembly of generally triangular configuration for canoes and the like comprising:

(a) a clamping assembly extending athwartships of said canoe at a point forwardly of its stern and including a support member extending athwartships of the canoe with its end portions extending over and outwardly of said sides of end portions extending over and outwardly of said sides of said canoe and supported on said gunwales, a clamping member engaged under said gunwales, and adjustable fasteners engaging said support and clamping members and releasably drawing them together to clamp them to said canoe;

(b) a transom mounting member extending generally in a vertical direction along said stern stem of said canoe and supporting said outboard motor on its upper end;

(c) a pair of adjustable length arms secured adjacent one end to said end portions of said support member of said clamping assembly and at the other end to said transom mounting member, said arms extending adjacent the gunwales of the associated canoe and converging towards said other ends and transom member; and (d) stabilizing means engaged with said transom mounting member and including a member depending from said transom member and means adjacent the lower end of said depending member fixedly engaging said depending member to the stern stem of said canoe at a point spaced downwardly from its gunwales, said transom mounting member being pivotably connected to said adjustable length arms and to said fixed engaging means of said stabilizing means to permit adjustment of its vertical orientation.

15. The motor mounting assembly in accordance with claim 14 wherein there is included adjustable arm stabilizing means interconnecting said adjustable length arms intermediate their length and rigidifying the motor mounting assembly.

16. The motor mounting assembly in accordance with claim 14 wherein said fixedly engaging means of said transom member stabilizing means includes a bracket secured to said stern stem of said canoe, and adjustable fastening means for varying the length of said elongated member between said transom mounting member and said bracket.

17. The motor mounting assembly in accordance with claim 14 wherein said adjustable length arms comprise telescoping tubular elements, and means for releasably locking said tubular elements in a desired length.

18. The motor mounting assembly in accordance with claim 14 wherein said adjustable length arms are mounted at said other end to said transom mounting member by a rod extending therethrough and through said transom mounting member.

19. The motor mounting assembly in accordance with claim 14 wherein said transom mounting member includes an elongated element and the upper end of said depending member of said stabilizing means is engaged therewith.

20. The motor mounting assembly in accordance with claim 15 wherein said arm stabilizing means comprises a pair of diagonally extending and intersecting members providing an X-shaped configuration.

* * * * *